US005953883A

United States Patent [19]

Ojala

[11] Patent Number: 5,953,883

[45] Date of Patent: Sep. 21, 1999

[54] INSULATED WALL PANEL

[76] Inventor: Leo V. Ojala, 163 Zerah Fiske Rd., Shelburne Falls, Mass. 01370

[21] Appl. No.: 08/985,517

[22] Filed: Dec. 5, 1997

[51] Int. Cl.[6] ..... E04B 1/88; E04C 2/36; E04C 2/52

[52] U.S. Cl. ..... 52/794.1; 52/220.1; 52/268; 52/270; 52/309.11; 52/407.3; 52/481.1

[58] Field of Search ..... 52/220.1, 267, 52/270, 309.9, 309.11, 309.14, 404.1, 404.3, 481.1, 794.1, 795.1, 265, 268, 269, 407.1, 407.3, 741.4, 742.13, 742.12

[56] References Cited

U.S. PATENT DOCUMENTS

| | | | |
|---|---|---|---|
| 3,305,986 | 2/1967 | Mathews | 52/794.1 X |
| 4,068,434 | 1/1978 | Day et al. | 52/309.11 X |
| 4,224,774 | 9/1980 | Petersen | 52/309.14 X |
| 4,471,591 | 9/1984 | Jamison | 52/309.9 |
| 4,488,390 | 12/1984 | Mulford | 52/407.1 |
| 4,641,468 | 2/1987 | Slater | 52/309.9 X |
| 4,658,557 | 4/1987 | Mulford | 52/407.1 |
| 4,674,253 | 6/1987 | Young | 52/794.1 X |
| 4,702,058 | 10/1987 | Bennett | 52/309.11 X |
| 4,765,105 | 8/1988 | Tissington et al. | 52/309.11 |
| 4,852,314 | 8/1989 | Moore, Jr. . | |
| 5,067,296 | 11/1991 | Brown et al. | 52/794.1 X |
| 5,297,369 | 3/1994 | Dickinson | 52/404.3 X |
| 5,433,050 | 7/1995 | Wilson et al. . | |
| 5,473,847 | 12/1995 | Crookston . | |
| 5,493,837 | 2/1996 | Hepler . | |
| 5,617,687 | 4/1997 | Bussey, Jr. et al. . | |
| 5,617,693 | 4/1997 | Hefner | 52/265 X |
| 5,765,330 | 6/1998 | Richard | 52/270 X |

OTHER PUBLICATIONS

Resource Conservation Technology, Inc., *Specification Sheet,* Mar. 1992.

Resource Conservation Technology, Inc., *Specification Sheet,* Sep. 1990.

*Primary Examiner*—Michael Safavi
*Assistant Examiner*—Kevin D. Wilkens
*Attorney, Agent, or Firm*—Wood, Herron & Evans, L.L.P.

[57] ABSTRACT

An insulated wall panel comprising a bottom, a plurality of inner members, a plurality of outer members, spacers between the inner members and the outer members, an insulation layer, an exterior sheathing, a vapor barrier, a top member and a planar interior wall. The insulated wall panel has a dead air space located just inside of a cavity filled with insulation. The wall panel is adapted to be secured to the frame of a timber frame home without fasteners passing through the entire depth of the panel. Fasteners secure the inner members of the panel only to the frame without destroying the integrity of the insulated wall panel.

22 Claims, 4 Drawing Sheets

INSULATED WALL PANEL

FIELD OF THE INVENTION

This invention relates to the manufacture and construction of building panels for residential, light commercial and commercial building construction.

BACKGROUND OF THE INVENTION

One popular type of home is what is considered in the construction industry a timber frame home. Timber frame homes are constructed of a plurality of heavy timber frame members and are designed so as to expose the timbers of the frame inside the home.

Traditionally a conventional light frame was built around or between the timbers filled with fiberglass insulation, covered on the inside with drywall and on the outside with siding. However, this method was slow, labor intensive and costly. In addition, it was not energy efficient because the insulation was interrupted every 16 inches by a stud or rafter allowing heat to easily escape and cold to enter at these points.

In the 1970's, structural insulating panels, commonly known in the industry as stress-skin panels, were developed for use in the residential construction of timber frame homes. The stress-skin panels were nailed to the exterior of the frame members leaving the frame exposed inside the home, thus creating an attractive appearance. These stress-skin panels used in conjunction with a timber frame replaced in many applications the standard 2×4 construction of homes. The stress-skin panels were considered stronger than 2×4s and were considered to provide better insulating capability.

A stress-skin panel is a panel comprising an outer skin, an inner skin and several inches of rigid foam insulation sandwiched between the two layers of sturdy sheathing material or skins. The outer and inner skins are usually made of plywood, waferboard or oriented strand board (OSB). Both plywood and OSB are commercially available only in certain size sheets. For example, plywood is typically available in 4'×8' sheets while OSB is typically available in larger size sheets (up to 8'×24'). The foam insulation core located between the two skins is expanded polystyrene (commonly called EPS) or urethane foam, typically 3½" thick. These panels are typically prefabricated before being installed as part of the walls or roofs of structures like homes, commercial offices, etc.

The stress-skin panels may be manufactured by injecting a liquid urethane between the two skins and allowing the liquid urethane to expand between the skins, the urethane foam adhering to the inner surfaces of the skins without any other adhesives. Alternatively, the foam insulation may be glued or adhesively secured to the outer sheathing layers or skins. However, over time the adhesive used to secure the foam insulation to the two skins may deteriorate if exposed to extreme temperature fluctuations causing the inner and outer skins to sheer apart from the foam insulation.

These stress-skin panels are secured to the heavy timber frame of a structure with long nails or screws known in the industry as pole, barn spikes or deck screws. The length of these nails or screws must be greater than the depth of the stress-skin panels so that the panels may be secured to the exterior surfaces of the timber frame of the structure, the nails or screws passing through the entire stress-skin panel and into the timber frame members.

Stress-skin panels are heavy, restricting the size of the panels. Therefore in order to construct the exterior of a building a large number of panels are required to be affixed to the timber frame of the building. Due to the weight of the stress-skin panels usually the use of a crane is required to lift the panels into place. This requires a great deal of time and manpower and is therefore relatively expensive.

In addition, some type of sealant must be inserted along the joints between adjacent stress-skin panels in order to reduce air and moisture flow through these joints. Alternatively, thin horizontal splines may be used between panels to minimize thermal breaks. Improperly sealed joints or seams can allow moisture to collect and the trapped moisture can eventually cause the materials of the stress-skin panels to swell and deteriorate.

Another drawback to the use of stress-skin panels is that in order to pass electrical wires through the panels, a hollow cardboard tube must be built into the foam insulation layer of the panels in order to create a passageway for the wires to pass through. These tubes passing through the insulation layer of the stress-skin panels reduce the insulating capability of the panels. Additionally, if an electrical outlet is to be located in the stress-skin panel, a portion of foam insulation and a portion of the inner skin must be removed in order to create a place for a conventional electrical box.

In cold climates where a large temperature differential exists between the exterior surface of panels and the interior of the structure, the nails or screws running through the panels may conduct heat and may cause condensation at the heads of the nails or screws. Over time, this condensation may cause the exterior layer of the stress-skin panels to rot which may eventually cause structural failure of the panels.

In addition, utilizing stress-skin panels is expensive. Because the interior layers or skins of the stress-skin panels are usually plywood, another layer of material such as drywall or wood paneling must be placed over and attached to the inner layer of the stress-skin panels to form the inner wall of the home. Similarly, a layer of siding or other material must be placed over the outer skins of the stress-skin panels.

In light of the aforementioned drawbacks of stress-skin panels, a need exists for a panel which is structurally sounder than current stress-skin panels and will not deteriorate or degrade over time due to seasonal temperature fluctuations. A need also exists for a panel which may be made of differing sizes so that an entire wall may be constructed of one panel rather than several pieces of panel. Also a need exists for a panel which does not require the use of long fasteners or nails which pass all the way through the panel in order to secure the panel to a timber frame.

Therefore, it has been one objective of the present invention to provide an insulated wall panel less susceptible to degradation over time than stress-skin panels.

It has a further objective of the present invention to provide an insulated wall panel which does not require long screws or nails to pass through the panel in order to secure the panel to a timber frame of a building.

It has been a further objective of the present invention to provide an insulated wall panel which may be made of many different sizes including the size of one entire wall.

SUMMARY OF THE INVENTION

The invention of this application which accomplishes these objectives comprises an insulated wall panel of a fixed width, a fixed height and a fixed depth. The insulated wall panel comprises a bottom member, a plurality of spaced, parallel vertically extending outer members, a plurality of spaced, parallel vertically extending inner members, a plurality of spacers between the inner and outer members, an exterior sheathing, a vapor barrier, insulation, a top member and a planar interior wall. The bottom member of the insulated wall panel of the present invention comprises one or more pieces of plywood extending the width of the panel. However, the depth of the bottom member of the wall panel is greater than the depth of the insulated wall panel. In other words, a portion of the bottom of the wall panel extends inwardly beyond the interior wall of the wall panel so that the bottom of the wall panel can be easily and conviently nailed to floor joists of the building in order to secure the wall panel in place.

Each of the outer members has an inside surface, an outside surface and two side surfaces. Each of the outer members is secured to the bottom member of the wall panel. All the outer members are approximately the same length.

Likewise, each of the inner members has an inside surface, an outside surface and two side surfaces. Each of the inner members has approximately the same length which is longer than the length of the outer members and is secured to the bottom member of the wall panel.

A plurality of spacers separate the inner and outer members. The spacers extend between the inner surfaces of the outer members and the outer surfaces of the inner members. A plurality of middle spacers including two endmost middle spacers secure each one of the outer members to a corresponding inner member in a one to one relationship. These middle spacers are located approximately half way up of the height of the insulated wall panel. Fasteners such as nails secure the middle spacers between one of the inner members and a corresponding outer member. In addition to the plurality of middle spacers, a horizontally extending top spacer extends between the inner surfaces of the outer members and the outer surfaces of the inner members. The top spacer is one piece, is secured to each of the inner members and each of the outer members and has a top surface which is generally coplanar with the top surfaces of the outer members. The top spacer provides a top to the insulated wall panel.

A planar exterior sheathing is secured to the outside surface of the outer members. This planar exterior sheathing may be one large sheet of plywood, oriented strand board, cement board, or a spun nylon barrier such as TYVEK® made by DuPont or other similar material. The planar exterior sheathing may alternatively be multiple pieces (for example, 4'×8' sheets of plywood) secured to the outer surface of the outer members. These individual pieces of exterior sheathing may be placed edge to edge so as to cover the entire outer surface of the wall panel.

A vapor barrier (typically made of plastic) is located against the outside surface of the inner members, is wrapped around the endmost or outermost middle spacers of the panel and is secured to the endmost outer members of the panel. The vapor barrier typically extends the full width and height of the insulated wall panel. This vapor barrier is typically air tight and made of a relatively strong plastic material.

The wall panel has insulation extending generally between the vapor barrier and the exterior sheathing. The insulation fills a cavity created by the bottom, the vapor barrier on the inside and sides, the exterior sheathing on the outside, and the top spacer on the top. The insulation goes around the middle spacers.

An upper portion of each of the inner members is secured to a top member which may be one piece laid flat on the top surfaces of the inner members or, alternatively, may be multiple pieces extending between adjacent upper portions of adjacent inner members. The function of this top member is to prevent air from escaping out the top of a dead air space created when the interior wall is placed on the inside of the insulated wall panel.

The last component of the insulated wall panel is a planar interior wall adapted to be secured to the inside surfaces of the inner members such that a dead air space is created between the bottom member, the top member, the vapor barrier and the interior wall. The planar interior wall may be gypsum wall board or plywood, milled boards or any other type of material which the home owner desires to have on the inside walls of the home.

The insulated wall panel may be sold to a home owner without the interior wall secured to the inside surface of the inner members. The insulated wall panel of the present invention enables a home owner to electrically wire the home without disturbing the insulation. Before the interior wall is secured to the inner members of the insulated wall panels, the home owner or electrical contractor may drill holes through the inner members of the insulated wall panels and pass electrical wires through these holes without disturbing the insulation located between the vapor barrier and the exterior sheathing (the remainder of the insulated wall panel). Once the house is electrically wired, the interior wall may be secured to the inside surfaces of the inner members creating a dead air space between the bottom member of the wall panel, the vapor barrier, the top member and the interior wall. This dead air space functions as a further insulation layer in addition to the insulation located in the cavity described hereinabove. In this manner, a house may be wired without having to puncture the vapor barrier and disturb the interior of the insulated wall panel.

The inner members are longer than the outer members so as to enable the insulated wall panel to be secured to a horizontal beam of a timber frame without disturbing the interior of the insulated wall panel and, more particularly, without any fastener passing through the entire depth of the insulated wall panel as has been done heretofore. Rather, with the present invention, the fasteners need only go through the top portions of the inner members. Therefore the insulated cavity between the vapor barrier and the exterior sheathing is undisturbed and has no fasteners passing therethrough. In this way, heat may not be conducted through the insulated wall panel through the fasteners and the wall panel is apt to last longer than heretofore known wall panels.

There and other objectives and advantages of the present invention will be even more readily apparent from the following detailed description of the drawings:

DETAILED DESCRIPTION OF THE PREFERRED EMBODIMENT

Figure 1:
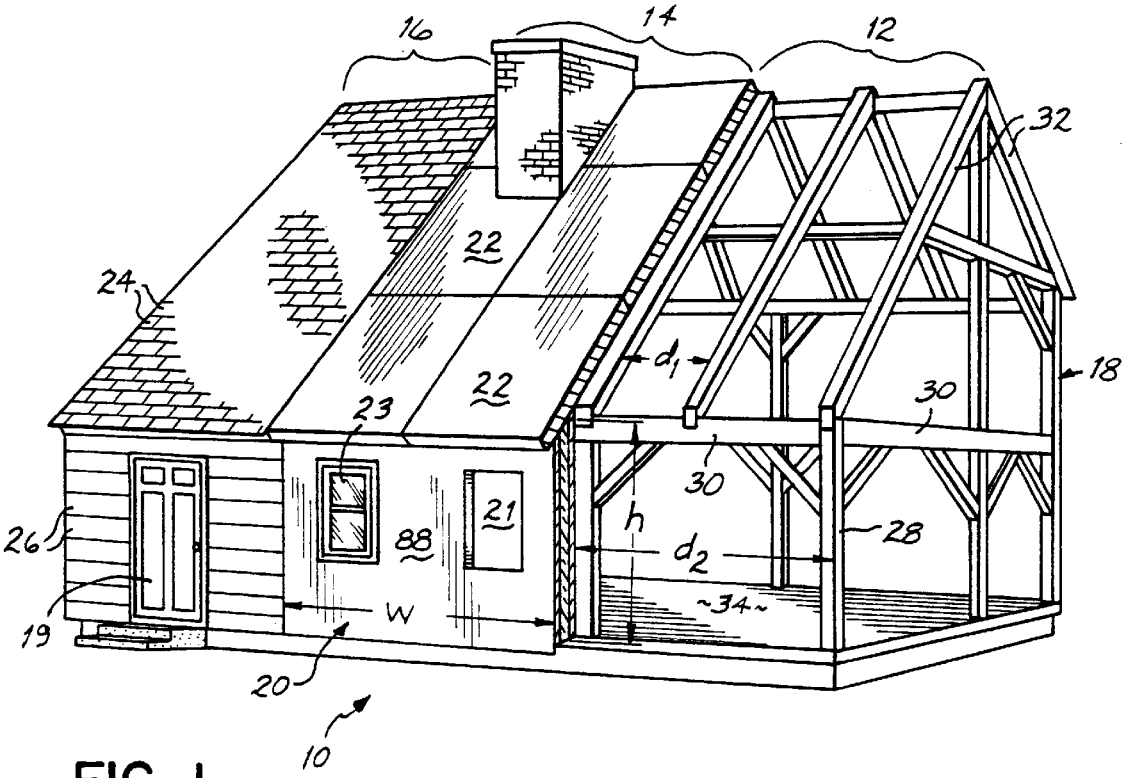
FIG. 1 is a perspective view of a home built using heavy timber frame construction divided into thirds, one third illustrating the timber frame itself, a second third illustrating the insulated wall panel of the present invention secured to the timber frame and the remaining third illustrating a finished home.

Referring to the drawings, and particularly to FIG. 1, there is illustrated a conventional timber frame home 10. For illustration purposes, the home is divided into thirds: a first third 12, a second third 14 and a last third 16 illustrating the progression of a home during construction of the home. The first third of the home 12 (seen in FIG. 1 as the rightmost third of the home) illustrates the frame 18 of a conventional timber frame home. The second third 14 (the middle third as seen in FIG. 1) illustrates the insulated wall panel of the present invention 20 secured to the timber frame 18 of the home and roof panels 22 secured to the rafters 32 of the timber frame 18. The last third 16 of the home (seen to the left in FIG. 1) illustrates shingles 24 secured to the roof panels 22 and pieces of siding 26 secured to the exterior of the insulated wall panel 20 of the present invention. Therefore, moving from right to left in FIG. 1, the different phases of construction of a timber frame home are illustrated to aid in the reader's understanding of the insulated wall panel of the present invention.

A timber frame home starts with a conventional wooden timber frame 18 and, more particularly, with spaced vertical timber frame members 28 which may be 6×8s or other sized lumber typical in the timber framing industry. These vertical members 28 are typically spaced apart from one another either 12, 14 or 16 feet but may be spaced apart any distance. Connecting the tops of the vertical frame members 28 are horizontal frame members 30 which go around the periphery of the home. Like the vertical frame members 28, these horizontal frame members may be 6×8s or any other sized members sufficient to support the insulated wall panels 20 of the present invention. Lastly, the timber frame 18 of the home comprises a plurality of rafters 32 which are used to support the roof of the home and are generally built in an inverted V-shaped configuration. Typically, the distance $d_1$ between the rafters 32 is less than the distance $d_2$ between the vertical members 28 of the timber frame.

Figure 2:
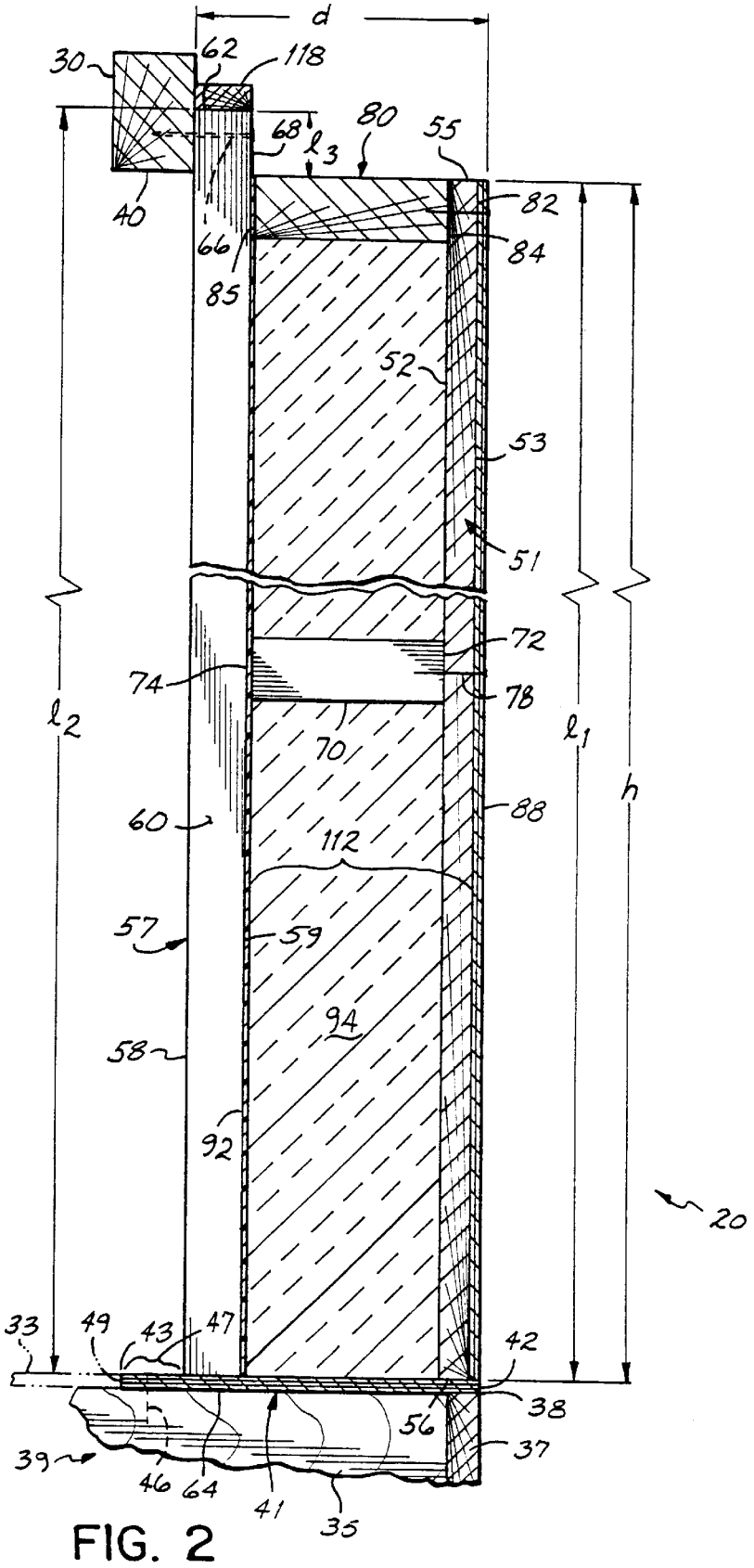
FIG. 2 is a cross-sectional elevational view of the insulated wall panel of the present invention secured to a horizontal beam or member of a timber frame.

Referring to the middle third 14 of the home 10 of FIG. 1, the insulated wall panel 20 of the present invention is secured to one of the horizontal members 30 of the timber frame and extends from the horizontal member 30 of the timber frame to the floor or supporting surface 34 of the home. As seen in FIGS. 1 and 2, each insulated wall panel 20 has a fixed width w, a fixed height h and a fixed depth d. As best illustrated in FIG. 1, the width w of the insulated wall panel 20 is approximately the same distance as the distance $d_2$, the distance between the centers of the vertical members 28 of the timber frame 18 which is typically 12, 14 or 16 feet but may be any distance. The vertical members 28 of the timber frame 18 provide further support for the insulated wall panels around the periphery of the home.

The depth d of the insulated wall panel 20 of the present invention may be any distance depending on the insulating capability or R value desired and the type of insulation used inside the panel.

The insulated wall panels 20 of the present invention are prefabricated, each being custom made for a particular home and having a predetermined length, width and depth. As illustrated in FIG. 1, the wall panels 20 may be prefabricated with openings or holes 21 therein adapted to receive one or more windows 23 or doors 19. In other words, the wall panel may be custom manufactured to include openings 21 for doors 19 and/or windows 23. The holes 21 do not compromise the integrity of the insulated wall panel and do not otherwise affect the construction or composition of the insulated wall panels 20.

Figure 3:
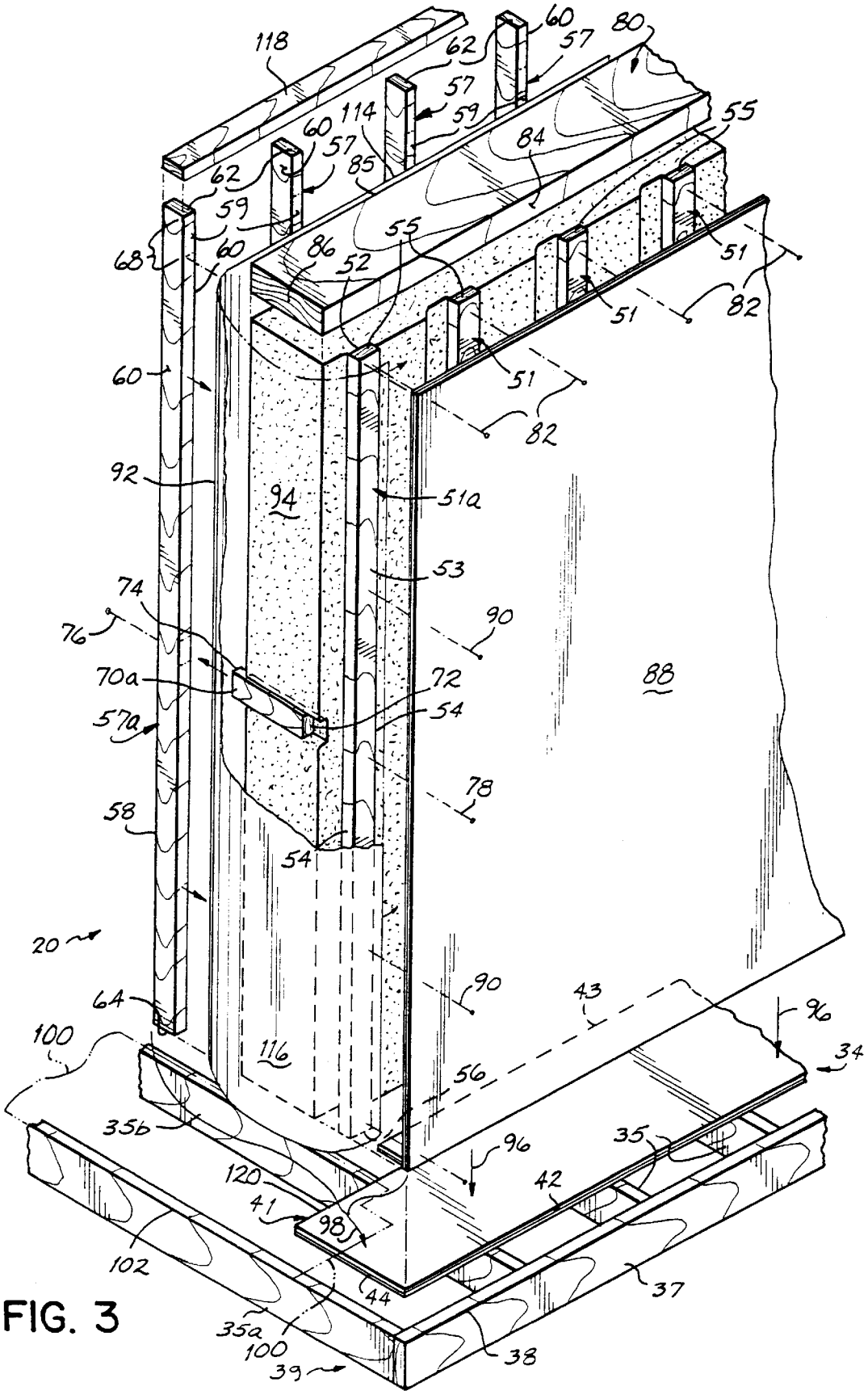
FIG. 3 is an exploded perspective view of the insulated wall panel of the present invention without the interior wall being secured to the insulated wall panel.

The height h of the insulated wall panel 20 must be at least the distance from the supporting surface 34 to the lower edge 40 of horizontal member 30 of the timber frame 18 or greater in order to properly insulate the home 10. The insulated wall panels 20 of the present invention are supported by and secured to floor joists 35. As best illustrated in FIG. 3, a floor frame 39 is made up of two outermost floor joists 35*a* (one of which is shown) and two end frame members 37 (one of which is shown). The floor joists 35 extend between the floor frame end members 37. The endmost or outermost floor joists 35*a* form the sides of the floor frame 39. As best seen in FIG. 2, the wall panels 20 of the present invention are placed around the periphery of a middle portion 33 of a floor or supporting surface 34.

Figure 4:
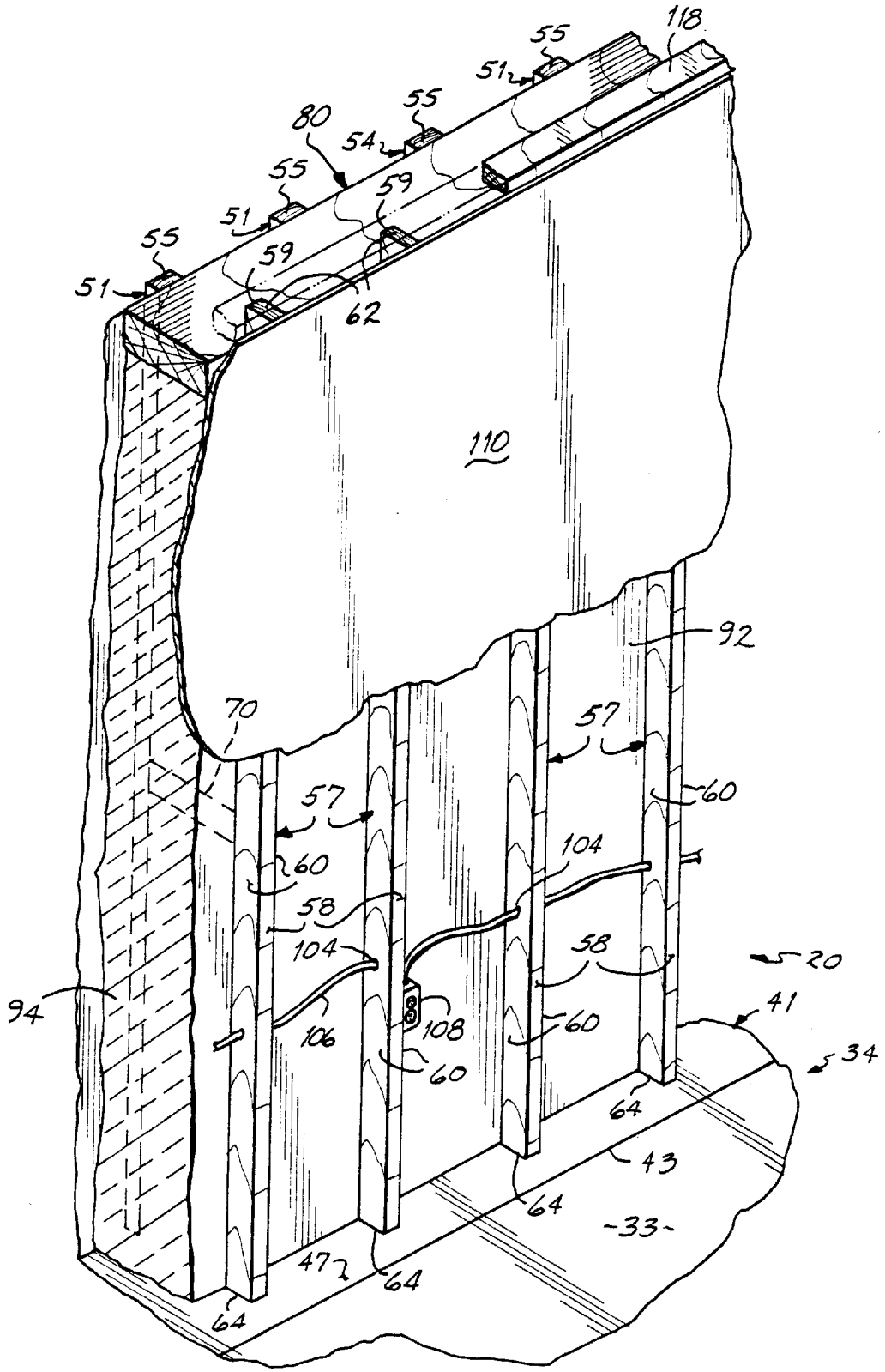
FIG. 4 is a perspective view of the insulated wall panel of the present invention with the interior wall secured to the inner members of the insulated wall panel.

Referring now to FIGS. 2–4, the insulated wall panel 20 of the present invention will be described in detail. The insulated wall panel 20 of the present invention has a bottom member 41 which may be made of plywood or any other material. The bottom member 41 of the insulated wall panel 20 has an outer edge 42, an inner edge 43 and two side edges 44 (one of which is shown). The bottom member 41 of the insulated wall panel 20 is the same width w as the wall panel but is of a greater depth, i.e. the distance from outer edge 42 to inner edge 43 of the bottom member 41 is greater than the depth d of the insulated wall panel (see FIG. 2). The bottom piece 41 of the insulated wall panel 20 extends further inwardly than the remainder of the wall panel 20 so that fasteners 46 may be quickly and easily passed through a rear portion 47 of the bottom member 41 of the insulated wall panel 20 and into the floor joists 35 in order to secure the insulated wall panels 20 in place. As seen in FIG. 2, the outermost edge 49 of the middle portion 33 of the floor or supporting surface 34 of the building abuts against the inner edge 43 of the bottom member 41 of the insulated wall panel 20 thus providing an uninterrupted coplanar floor or supporting surface 34 of the building or home.

A plurality of spaced, parallel, vertically extending outer members 51 including two endmost or outermost outer members (only one 51*a* being shown) are secured to the bottom member 41 of the wall panel 20. These outer members 51 are typically made of wood; however, they may be made of any material and need not necessarily be wood. Likewise, these outer members 51 are typically 2×4s but may be of any size.

As best illustrated in FIG. 3, each of these outer members 51 has an inside surface 52, an outside surface 53 and two side surfaces 54. The outer members 51 are oriented such that the inside and outside surfaces 52, 53 have more surface area than the two side surfaces 54. In other words, the outer members 51 are "laid on the flat" with the larger surface areas comprising the inside and outside surfaces 52, 53. Each of these outer members 51 is approximately the same length $l_1$ (see FIG. 2) which is the same height as the height h of the wall panel 20 generally. Each of these outer members 51 has a top surface 55 and a bottom surface 56. The bottom surfaces 56 of the outer members are coplanar and adapted to lay flat on the top surface of bottom member 41 of the wall panel 20. Because the outer members 51 are the same length $l_1$, the top surfaces 55 of outer members 51 are coplanar as well.

The insulated wall panel 20 further comprises a plurality of spaced, parallel, vertically extending inner members 57 including two endmost or outermost inner members (only one 57*a* of which is shown) which are secured to the bottom member 41 of the insulated wall panel 20. As seen in FIG. 3, each of these inner members 57 has an inside surface 58, an outside surface 59, two side surfaces 60 which are diametrically opposed to surfaces 58 and 59, a top surface 62 and a bottom surface 64. Unlike the outer members 51, the inner members 57 are not "laid on the flat" but rather are oriented such that the inside and outside surfaces 58, 59 generally have less surface area than the side surfaces 60 of the inner members 57. These inner members 57 are typically made of wood but may be made of other materials. In addition, the inner members 57 are typically 2×3s but may be other sizes such as 2×4s. Each of the inner members 57 and each of the outer members 51 may be secured to the bottom member 41 with a screw or fastener (not shown).

Referring to FIG. 2, each of these inner members 57 is of the same length $l_2$ which is greater than the length $l_1$ of the outer members 51. The reason the length of the inner members 57 $l_2$ is greater than the length $l_1$ of the outer members 51 is so that the difference $l_3$ between the length $l_2$ of the inner members 57 and the length $l_1$ of the outer members 51 enables a fastener 66 to pass through an upper portion 68 of the inner members 57 and into the interior of a horizontal member 30 of the timber frame 18 without disturbing the interior of the remainder of the insulated wall panel 20 (see FIG. 2). The top surfaces 62 of the inner members 57 are generally coplanar because the inner members 57 are all approximately the same length $l_2$. Likewise, the bottom surfaces 64 of the inner members 57 are also generally coplanar with each other and with the bottom surfaces 56 of the outer members 51. Like the bottom surfaces 56 of the outer members 51, the bottom surfaces 64 of the inner members 57 lie flat on the bottom member 41 of the wall panel 20 as best seen in FIG. 2.

The inner and outer members 57, 51 are spaced apart by a plurality of middle spacers 70. Each middle spacer 70 secures one of the inner members 57 to one of the outer members 51, as illustrated in FIG. 3. Each spacer 70 extends between the inside surface 52 of an outer member 51 and the outside surface 59 of the corresponding inner member 57 with end surface 72 of the middle spacer 70 abutting the inside surface 52 of the outer member 51 and the end surface 74 abutting the outside surface 59 of the inner member 57. These middle spacers 70 are located approximately half way up the height of the insulated wall panel and provide stability to the wall panel as a whole. Fasteners 76 pass through the inner members 57 and end surfaces 74 of middle spacers 70 to secure the middle spacers 70 to the inner members 57. Likewise, fasteners 78 pass through the outer members 51 and end surfaces 72 of middle spacers 70 to secure the outer members 51 to the middle spacers 70.

In addition to the middle spacers 70, a top plate or spacer 80 extends between the inside surface 52 of the outer members 51 and the outside surface 59 of the inner members 57. The top spacer 80 is a one piece member and is secured to each of the inner members 57 and each of the outer members 51 with fasteners 82. The top spacer 80 has two side surfaces 84, 85 which abut against the inside surface 52 of the outer members 51 and the outside surface 59 of the inner members 57 respectively. Likewise, the top spacer 80 has two end surfaces 86 which are generally coplanar with the outer side surfaces 54 of the endmost outer members 51*a* (one of which is shown) and the outer side surfaces 60 of the endmost inner members 57*a* (one of which is shown).

A planar exterior sheathing 88 is secured to the outside surfaces 53 of the outer members 51 with fasteners 82. Thus, fasteners 82 secure the outer sheathing 88 to the outer members 51 and the outer members 51 to the top spacer 80. In addition, extra fasteners 90 may secure the exterior sheathing 88 to the outside surfaces 53 of the outer members 51 only. This exterior sheathing 88 may be made of a rigid, non-flexible material such as plywood, oriented strand board (OSB) or cement board or made from a flexible material such as a spun nylon barrier such as TYVEK® made by DuPont but may be any other type of material. If a flexible outer sheathing 88 is used, a rigid brace such as an X-shaped aluminum member may be placed outside the flexible sheathing 88 and secured to selected outer members 51 in order to further stabilize the insulated wall panel 20. This exterior sheathing 88 may be one piece of material which covers the entire outside surface of the wall panel or, alternatively, may be multiple pieces of exterior sheathing placed edge to edge so as to cover the entire width and height of the wall panel.

Another component of the insulated wall panel 20 of the present invention is a vapor barrier 92. The vapor barrier 92 is located against the outside surfaces 58 of the inner members 57 of the wall panel 10, wrapped around the endmost middle spacers 70*a* (one of which is shown) and secured to the endmost outer members 51*a* (one of which is shown). Thus, as seen in FIG. 3, the vapor barrier 92 has a planar middle portion 114 and two end portions 116 (one of which is shown). This vapor barrier 92 is preferably made of plastic such as polyethylene and is preferably impervious to water vapor and air. One such type of vapor barrier is an 8 millimeter stabilized polyethylene called TENOARM™ manufactured by Treleborg Industries located in Stockholm, Sweden and is distributed in the United States by Resource Conservation Technology of Baltimore, Md. This vapor barrier 92 preferably extends the full height h and width w of the wall panel 20 and functions so as to create an inner barrier for a layer of insulation 94 and as an inner surface of an air pocket (not numbered) created when interior wall 110 is secured to the inner members 57 of the wall panel 20. The vapor barrier 92 is sandwiched between the end surfaces 74 of middle spacers 70 and the outside surfaces 59 of the inner members 57 of the wall panel and between the side surface 85 of the top spacer 80 and the outside surfaces 59 of the inner members 57. Thus, an interior cavity or pocket 112 (see FIG. 2) is formed between the bottom 41 of the wall panel, the vapor barrier 92, the top spacer 80, and the outer sheathing 88. This interior cavity 112 is filled with insulation 94 which may be cellulose insulation or conventional fiberglass insulation or any other type of insulating material. No adhesive is required to keep the insulation in the interior cavity 112 unlike stress-skin panels.

A top member 118 may be secured to the top surfaces 62 of the inner members 57 as illustrated in FIG. 3 so as to provide a top for the air cavity created when the interior wall or interior sheathing 110 is placed on the inside of the wall panel 20 as illustrated in FIG. 4. The top member 118 may be one piece or, alternatively, multiple pieces, each piece extending between two adjacent inner members 54 as long as the top member 118 extends the full width w of the wall panel and creates a ceiling for the air pocket created when the interior wall or sheathing 110 is placed on the inside of the wall panel.

Once the insulated wall panel as described hereinabove is pre-assembled, the panel may be installed. To install a panel, the panel is moved downwardly and outwardly in a direction illustrated by arrows 96 and 98 (see FIG. 3) so that the outer sheathing 88 of the wall panel 20 is generally coplanar in a vertical plane with the outer edge 38 of the end members 37 of the floor frame 39 (see FIGS. 2 and 3). Fasteners 46 are then passed through the bottom member 41 of the wall panel 20 and into the floor joists 35 in order to secure the bottom of the wall panel in place. The upper portions 68 of the inner members 57 of the insulated wall panel 20 may then be secured to one of the horizontal members 30 of the timber frame 18 (see FIG. 1).

In order to secure a second panel (not shown) at right angles to the wall panel just installed, the second wall panel (not shown) is placed inside the phantom footprint 100 of second or corner mating wall panel (not shown) (see FIG. 3) with outer edge 42 of the bottom piece 41 of the second panel (not shown) placed on top of the outer edge 102 of the outermost floor joist 35*a*. The bottom piece 41 of the second panel is then secured to the floor joists 35. The top of the second panel is then secured to a horizontal member 30 of the timber frame 18 so that the two panels form a right angle at a corner of the home. The bottom piece 41 of each insulated wall panel 20 may have a rectangular cut-out portion 120, enabling the wall panels 20 to form a right angle with no gaps between the wall panels 20.

Once a panel is thus installed, a plurality of holes 104 may be drilled through the inner members 57 without disturbing the vapor barrier 92 as illustrated in FIG. 4. Electrical wiring 106 may be inserted through the holes 104 and be secured to outlet boxes 108 secured to the inner members 57. Thus, a timber frame home constructed with the insulated wall panels 20 of the present invention may be electrically wired without disturbing the insulation contained within the wall panels 20.

Lastly, as illustrated in FIG. 4, an interior wall or sheathing 110 may be secured to the inside surfaces 58 of the inner members 57 so as to create a dead air space between the vapor barrier 92 and the interior wall 110. This interior wall or sheathing 110 may be plywood, gypsum wall board or any other material which the home owner desires to use on the inside of the home. The dead air space located between the vapor barrier 92 and the interior wall 110 functions as further insulation in addition to the insulation 94 inside cavity 112. The interior walls 110 may be one piece or, alternatively, multiple pieces put together edge to edge so as to cover the entire surface area of the walls of the home.

While I have described one preferred embodiment of the present invention, persons skilled in the art may appreciate minor modifications which may be made to the present invention without departing from the spirit of the invention. Therefore, I do not intend to be limited except by the scope of the following claims:

I claim:

1. An insulated wall panel adapted to receive interior sheathing, said insulated wall panel comprising:

a bottom member, a plurality of spaced, parallel vertically extending outer members including two endmost outer members secured to said bottom member, each of said outer members having an inside surface and an outside surface and being of a first length, a plurality of spaced, parallel vertically extending inner members secured to said bottom member, each of said inner members having an outside surface and an inside surface and being of a second length, exterior sheathing secured to said outside surfaces of the outer members, a vapor barrier secured to the outside surfaces of the inner members so as to expose said inner members for purposes of passing wires through holes in said inner members before the interior sheathing is secured to the inside surfaces of said inner members, insulation located between the vapor barrier and the exterior sheathing.

2. The insulated wall panel of claim 1 wherein said second length is greater than said first length.

3. The insulated wall panel of claim 1 wherein said insulation is non-rigid insulation.

4. The insulated wall panel of claim 1 wherein said vapor barrier is made of polyethylene.

5. The insulated wall panel of claim 1 further comprising at least one top member secured to an upper portion of each of said inner members, said at least one top member, said vapor barrier and said bottom member defining a dead air space with said interior sheathing once said interior sheathing is secured to the inside surfaces of said inner members.

6. The insulated wall panel of claim 1 wherein said inner members are of sufficient length so that fasteners may secure said inner members to a horizontal member of a timber frame without passing through said insulation.

7. An insulated wall panel adapted to receive interior sheathing said insulated wall panel comprising:

a bottom, a plurality of spaced, parallel vertically extending outer members including two endmost outer members, each of said outer members having an inside surface and an outside surface, a plurality of spaced, parallel vertically extending inner members, each of said inner members having an inside surface and an outside surface, a plurality of horizontally oriented spacers extending between the inside surface of the outer members and the outside surface of the inner members, exterior sheathing secured to the outside surface of the outer members, a vapor barrier, said vapor barrier being secured to the outside surfaces of the inner members; and insulation extending between said vapor barrier and said exterior sheathing whereby wires may be passed through said inner members without disturbing said vapor barrier prior to said interior sheathing being secured to the inside surfaces of said inner members.

8. The insulated wall panel of claim 7 wherein said vapor barrier is wrapped around selected spacers and secured to the endmost outer members.

9. The insulated wall panel of claim 7 wherein said vapor barrier is polyethylene.

10. The insulated wall panel of claim 7 wherein said vapor barrier is made of plastic.

11. The insulated wall panel of claim 7 wherein each of said spacers extends between one of the outer members and one of the inner members.

12. The insulated wall panel of claim 7 wherein said inner members have holes therethrough for passage of electrical wires.

13. The insulated wall panel of claim 7 wherein said inside surfaces of said inner members are adapted to receive said interior sheathing.

14. The insulated wall panel of claim 7 wherein said outer members and said inner members are made of wood.

15. The insulated wall panel of claim 7 wherein each of said outer members is of a first length and each of said inner members is of a second length, said second length being greater than said first length.

16. The insulated wall panel of claim 15 wherein the difference between said second length and said first length is sufficient so as to enable upper portions of the inner members to be secured to a horizontal timber frame beam without disturbing the remainder of said insulated wall panel.

17. The insulated wall panel of claim 7 further comprising at least one top member secured to an upper portion of each of said inner members, said at least one top member, said bottom and said vapor barrier together with said interior sheathing once said interior sheathing is secured to the inside surfaces of said inner members defining a dead air space in order to better insulate said insulated wall panel.

18. The insulated wall panel of claim 17 wherein said horizontally oriented spacers include a top spacer and a plurality of middle spacers spaced below said top spacer.

19. An insulated wall panel adapted to receive interior sheathing, said insulated wall panel comprising:

a bottom, a first set of spaced, parallel outer members including two outermost outer members secured to said bottom, each outer member having an inside surface and an outside surface, a second set of spaced, parallel inner members secured to said bottom, each inner member having an inside surface and an outside surface, a plurality of horizontally oriented spacers including two outermost spacers, said spacers extending between the inside surfaces of the outer members and the outside surfaces of the inner members, and securing said outer members to said inner members, exterior sheathing secured to the outside surfaces of the outer members, a vapor barrier secured to the outside surfaces of the inner members and being wrapped around the outermost spacers and secured to the outermost outer members so as to define an interior cavity with said bottom of said insulated wall panel and said exterior sheathing, said interior cavity being filled with insulation, whereby wires may be passed through holes in said inner members without disturbing said interior cavity prior to said interior sheathing being secured to the inside surfaces of said inner members.

20. The insulated wall panel of claim 19 wherein each of said inner members is of a length greater than the length of a corresponding outer member.

21. The insulated wall panel of claim 19 wherein said insulation is non-rigid insulation.

22. The insulated wall panel of claim 19 wherein said vapor barrier is airtight.

* * * * *